US009335652B2

(12) United States Patent
Watanabe et al.

(10) Patent No.: US 9,335,652 B2
(45) Date of Patent: May 10, 2016

(54) OPTICAL WRITING DEVICE AND IMAGE FORMING APPARATUS

(71) Applicant: Konica Minolta, Inc., Chiyoda-ku (JP)

(72) Inventors: Yoshikazu Watanabe, Toyohashi (JP); Satoshi Masuda, Neyagawa (JP); Makoto Obayashi, Toyokawa (JP); Masayuki Iijima, Okazaki (JP); So Yano, Ibaraki (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 14/182,379

(22) Filed: Feb. 18, 2014

(65) Prior Publication Data

US 2014/0232805 A1 Aug. 21, 2014

(30) Foreign Application Priority Data

Feb. 20, 2013 (JP) ..... 2013-031290

(51) Int. Cl.
*G03G 15/043* (2006.01)
*G03G 15/04* (2006.01)

(52) U.S. Cl.
CPC ..... *G03G 15/043* (2013.01); *G03G 15/04054* (2013.01)

(58) Field of Classification Search
CPC ..... B41J 2/45; B41J 2/455; B41J 2/44; B41J 2/447; G03G 15/043
USPC ..... 347/130
See application file for complete search history.

(56) References Cited

U.S. PATENT DOCUMENTS

| | | | |
|---|---|---|---|
| 7,504,616 | B2 | 3/2009 | Nakamura et al. |
| 2009/0140658 | A1 | 6/2009 | Jo et al. |
| 2011/0228036 | A1 | 9/2011 | Kyogoku |

FOREIGN PATENT DOCUMENTS

| | | | |
|---|---|---|---|
| CN | 101927617 | A | 12/2010 |
| EP | 1326198 | A2 | 7/2003 |

(Continued)

OTHER PUBLICATIONS

Notification of First Office Action issued in corresponding Chinese Patent Application No. 201410057214.2, dated Sep. 6, 2015, and English translation. (21 pages).

(Continued)

*Primary Examiner* — Alessandro Amari
*Assistant Examiner* — Michael Konczal
(74) *Attorney, Agent, or Firm* — Buchanan Ingersoll & Rooney PC

(57) ABSTRACT

An optical writing device having; a plurality of light-emitting points; a plurality of drive circuits for supplying drive currents to the plurality of light-emitting points respectively; a photodetector for outputting signals indicating quantities of light entering thereto from the respective light-emitting points; a gain switch circuit for outputting photodetection signals obtained by amplifying the signals output from the photodetector in regard to the respective light-emitting points with gains preset for the respective light-emitting points; and a control circuit for controlling the drive circuits such that the photodetection signals output from the gain switch circuit in regard to the respective light-emitting points coincide with a value substantially equal to a predetermined reference value. The gains for the respective light-emitting points are preset based on the distances between the photodetector and the respective light-emitting points.

12 Claims, 12 Drawing Sheets

(56) References Cited

FOREIGN PATENT DOCUMENTS

| | | | |
|---|---|---|---|
| JP | 08-168482 | | 7/1996 |
| JP | 2003-266791 | | 9/2003 |
| JP | 2007-276355 | A | 10/2007 |
| JP | 2007276355 | A | 10/2007 |
| JP | 2009-154530 | | 7/2009 |
| JP | 2009154530 | A * | 7/2009 |
| JP | 2011-156690 | | 8/2011 |

OTHER PUBLICATIONS

Notification of Reasons for Refusal issued in corresponding Japanese Patent Application No. 2013-031290, dated Jan. 6, 2015, and English translation. (8 pages).

* cited by examiner

OPTICAL WRITING DEVICE AND IMAGE FORMING APPARATUS

This application is based on Japanese Patent Application No. 2013-31290 filed on Feb. 20, 2013, the content of which is incorporated herein by reference.

BACKGROUND OF THE INVENTION

1. Field of the Invention

The present invention relates to an optical writing device including a photodetector for detecting the quantities of light emitted from a plurality of light-emitting points, and an image forming apparatus provided with the optical writing device.

2. Description of Related Art

In the field of image forming apparatuses, there have been a demand for reducing the size, and the demand is getting stronger. In order to comply with the demand, optical writing devices used in image forming apparatuses are being changed from an optical scanning type to a line optical type. (In the following, an optical writing device will be also referred to as a PH (print head)). An optical writing device of the optical scanning type scans a light beam emitted from a light source (for example, a laser diode) on a photoreceptor surface via a scanning optical system such as a polygon mirror or the like. An optical writing device of the line optical type scans light emitted from a light-emitting-point array including a multiple of very small light-emitting points arranged in a line on a photoreceptor surface directly not via a scanning optical system.

As one of the optical writing devices of the line optical type, there has been developed a device having a light-emitting-point array including a plurality of LEDs (light-emitting diodes) arranged in a line. (Such a device will be hereinafter referred to as an LPH.) With respect to the LPH, generally, the light-emitting-point array and a drive circuit for controlling light emission from the light-emitting-point array are mounted on separate substrates. Accordingly, the manufacturing cost of the LPH becomes higher.

From the background, recently, as a low-cost optical writing device of the line optical type, there has been suggested a device comprising a light-emitting-point array including a plurality of organic LEDs (organic light-emitting diodes) arranged in a line. (Such a device will be hereinafter referred to as an OLED-PH.) With respect to the OLED-PH, the OLEDs and thin-film transistors (TFTs) can be mounted on the same substrate. Accordingly, a low-cost optical writing device can be realized.

OLEDs, however, have light-quantity degradation characteristics as follows: (1) the quantity of light becomes smaller (the light-quantity degradation) as the cumulated light-emitting time increases; (2) the rate of progression of light-quantity degradation differs depending on luminance; and (3) the degree of light-quantity degradation differs depending on temperature.

In the OLED-PH, different OLEDs have different accumulated light-emitting times depending on images to be written, and because of the light-quantity degradation characteristics above, different pixels have different degrees of light-quantity degradation. In order to deal with this problem, the OLED-PH needs to be subjected to light-quantity adjustment in a pixel-by-pixel manner as disclosed by Japanese Patent Laid-Open Publication No. 2007-276355. According to Japanese Patent Laid-Open Publication No. 2007-276355, a light-quantity detection circuit comprises: light-emitting points (OLEDs); a substrate supporting the light-emitting points; a light-quantity detector supported by the substrate, the light-quantity detector located in front of the light-emitting points; and an integrating circuit for integrating outputs from the light-quantity detector. In this structure, even a low-sensitivity photodetector can carry out satisfactory light-quantity detection.

Not only in the OLED-PH but also in any other optical writing device wherein the quantities of light emitted from a plurality of light-emitting points are detected by a single photodetector, the quantities of light incident from different light-emitting points to the light-quantity detector are different. In this case, the photodetector has different dynamic ranges for different light-emitting points. For example, the smaller the quantity of incident light, the lower the dynamic range, and the photodetector has a problem that the detection accuracy of the photodetector for a smaller quantity of light is lower.

The present invention provides an optical writing device with a higher detection accuracy, and an image forming apparatus comprising the optical writing device.

SUMMARY OF THE INVENTION

A first aspect of the present invention provides an optical writing device comprising: a plurality of light-emitting points; a plurality of drive units for supplying drive currents to the plurality of light-emitting points respectively; a photodetector for outputting signals indicating quantities of light entering thereto from the respective light-emitting points; a gain switch unit for outputting photodetection signals obtained by amplifying the signals output from the photodetector in regard to the respective light-emitting points with gains preset for the respective light-emitting points; and a control unit for controlling the drive units such that the photodetection signals output from the gain switch unit in regard to the respective light-emitting points coincide with a value substantially equal to a predetermined reference value. The gains for the respective light-emitting points are preset based on the distances between the photodetector and the respective light-emitting points.

A second aspect of the present invention provides an optical writing device comprising: a plurality of light-emitting points; a lens for transmitting light emitted from the light emitting points to focus the light on an object; a plurality of drive units for supplying drive currents to the plurality of light-emitting points respectively; a photodetector for outputting signals indicating quantities of light entering thereto from the respective light-emitting points; a gain switch unit for outputting photodetection signals obtained by amplifying the signals output from the photodetector in regard to the respective light-emitting points with gains preset for the respective light-emitting points; and a control unit for controlling the drive units such that the photodetection signals output from the gain switch unit in regard to the respective light-emitting points coincide with a value substantially equal to a predetermined reference value. The gains for the respective light-emitting points are preset based on the transmittances of light emitted from the respective light-emitting points through the lens.

A third aspect of the present invention provides an optical writing device comprising: a plurality of light-emitting points; a lens for transmitting light emitted from the light emitting points to focus the light on an object; a plurality of drive units for supplying drive currents to the plurality of light-emitting points respectively; a photodetector for outputting signals indicating quantities of light entering thereto from the respective light-emitting points; a gain switch unit for outputting photodetection signals obtained by amplifying the signals output from the photodetector in regard to the respective light-emitting points with gains preset for the respective light-emitting points; and a control unit for controlling the drive units such that the photodetection signals output from the gain switch unit in regard to the respective light-emitting points coincide with a value substantially equal to a predetermined reference value. The gains for the respective light-emitting points are preset based on the distances between the photodetector and the respective light-emitting points and the transmittances of light emitted from the respective light-emitting points through the lens.

A fourth aspect of the present invention provides an optical writing device comprising: a plurality of light-emitting points; a plurality of drive units for supplying drive currents to the plurality of light-emitting points respectively; a photodetector for outputting signals indicating quantities of light entering thereto from the respective light-emitting points; a gain switch unit for outputting photodetection signals obtained by amplifying the signals output from the photodetector in regard to the respective light-emitting points with gains preset for the respective light-emitting points; and a control unit for controlling the drive units such that the photodetection signals output from the gain switch unit in regard to the respective light-emitting points coincide with a value substantially equal to a predetermined reference value. The control unit receives photodetection signals from the gain switch unit while making the respective light-emitting points emit light under a predetermined initial condition and sets the gains for the respective light-emitting points preliminarily in the gain switch unit based on the received photodetection signals.

DETAILED DESCRIPTION OF THE PREFERRED EMBODIMENTS

Introduction

Figure 1:
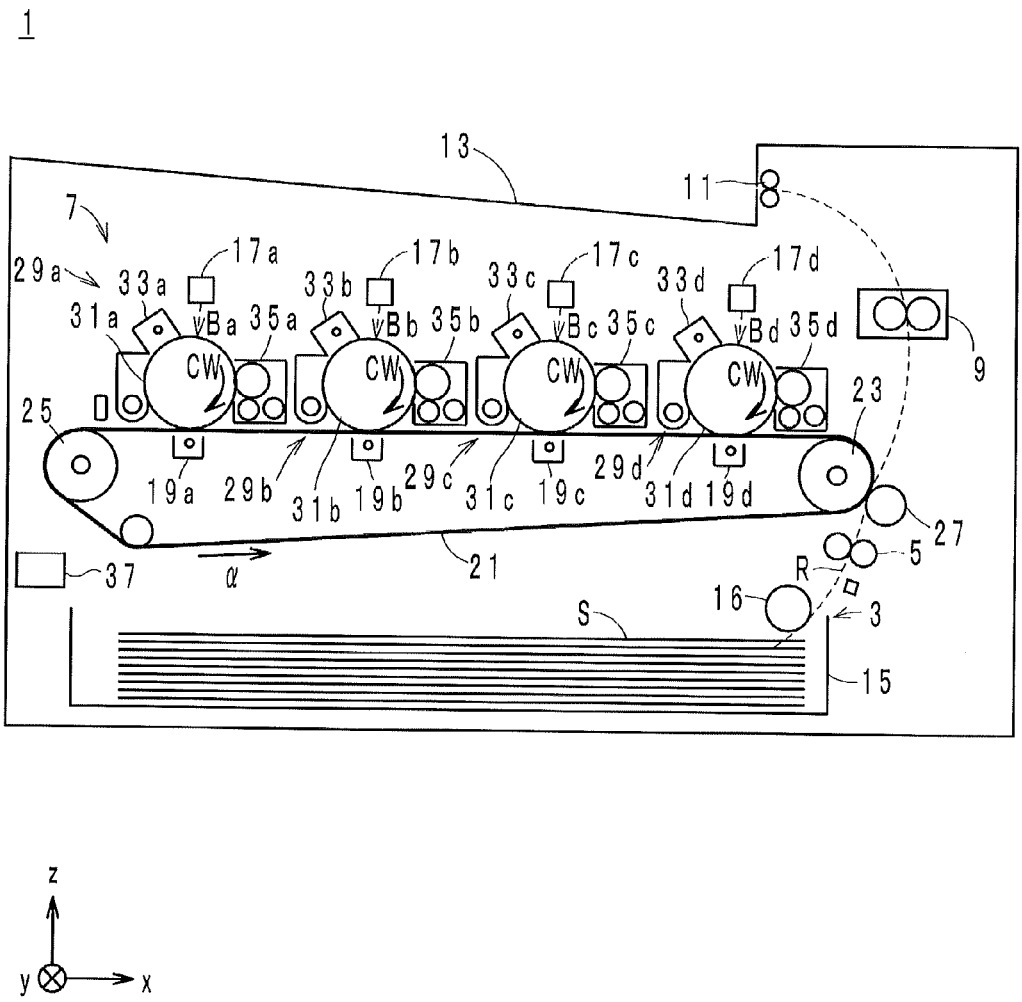
FIG. 1 is a schematic view of an image forming apparatus comprising an optical writing device according to an embodiment.

An image forming apparatus capable of adopting any one of the optical writing devices according to some embodiments of the present invention is described, with reference to the drawings.

First, the x-axis, the y-axis and the z-axis in the drawings are described. In the following description of the embodiments, for convenience sake, the x-axis, the y-axis and the z-axis are the right-left direction (horizontal direction), the front-back direction (depth direction) and the up-down direction (vertical direction). In the drawings, some elements are denoted by reference numbers with suffixes a, b, c and d attached thereto. The suffixes a, b, c and d mean yellow (Y), magenta (M), cyan (C) and black (Bk), respectively. For example, an image forming unit 29*a* means an image forming unit 29 for yellow. A reference numbers with no suffix means an element for each of the colors Y, M, C and Bk. For example, an image forming unit 29 means each of the image forming units respectively for the colors Y, M, C and Bk.

Structure and Operation of the Image Forming Apparatus

In FIG. 1, the image forming apparatus 1, which is, for example, an MFP (multifunction peripheral), forms toner images in the respective colors by using photoreceptor drums 31 for the respective colors, combines the toner images to form a composite toner image and prints the composite toner image on a sheet S. For this purpose, the image forming apparatus 1 generally comprises a sheet feed unit 3, a pair of timing rollers 5, a process unit 7, a fixing device 9, a pair of ejection rollers 11 and a printed-sheet tray 13.

The sheet feed unit 3 comprises a feed tray 15 and feed roller 16. On the feed tray 15, a plurality of sheets S to be printed are stacked. The feed roller 16 picks up the topmost one from the stack of sheets S and feeds the sheet S into a sheet path R. The sheet S is fed toward the pair of timing rollers 5 located immediately downstream.

The pair of timing rollers 5 comprises a pair of rollers in contact with each other on the sheet path R. The pair of timing rollers 5 are rotated and stopped under control of a control circuit 37. The pair of timing rollers 5 stays in a stopped state except for the time of feeding the sheet S. Accordingly, the sheet S fed to the pair of timing rollers 5 runs head-on into a contact portion of the timing rollers 5, whereby the sheet S stops. Thereafter, the pair of timing rollers 5 starts rotating at predetermined timing to feed the sheet S toward a secondary transfer area, which will be described later.

The process unit 7 comprises OLED-PHs 17 for the respective colors, transfer devices 19 for the respective colors, an intermediate transfer belt 21, a drive roller 23, a driven roller 25, a secondary transfer roller 27, and image forming units 29 for the respective colors. Each of the image forming units 29 generally comprises a photoreceptor drum 31, and a set of a charger 33 and a developing device 35 arranged along the peripheral surface of the photoreceptor drum 31.

Each of the photoreceptor drums 31 for the respective colors extends in the y-axis direction. These photoreceptor drums 31 are arranged in the x-axis direction. Each of the photoreceptor drums 31 is driven by a motor M (not shown) to rotate clockwise (shown by arrow CW) in a zx-plane about an axis in parallel to the y-axis direction.

Each of the chargers 33 extends in the y-axis direction and charges the peripheral surface of the corresponding photoreceptor drum 31. The chargers 33 are typically corotron chargers, scorotron chargers or charging rollers.

Each of the OLED-PHs 17 is an optical writing device located near the peripheral surface of the corresponding photoreceptor drum 31 and immediately downstream of the corresponding charger 33 in the rotating direction CW of the photoreceptor drum 31. Each of the OLED-PHs 17, as shown by FIG. 2, comprises at least an OLED substrate 52 and a lens array 53 held in a holder 51.

The holder 51 extends in parallel to the corresponding photoreceptor drum 31 and is opposed to an exposure position where the corresponding photoreceptor drum 31 is exposed to a light beam B.

Figure 2:
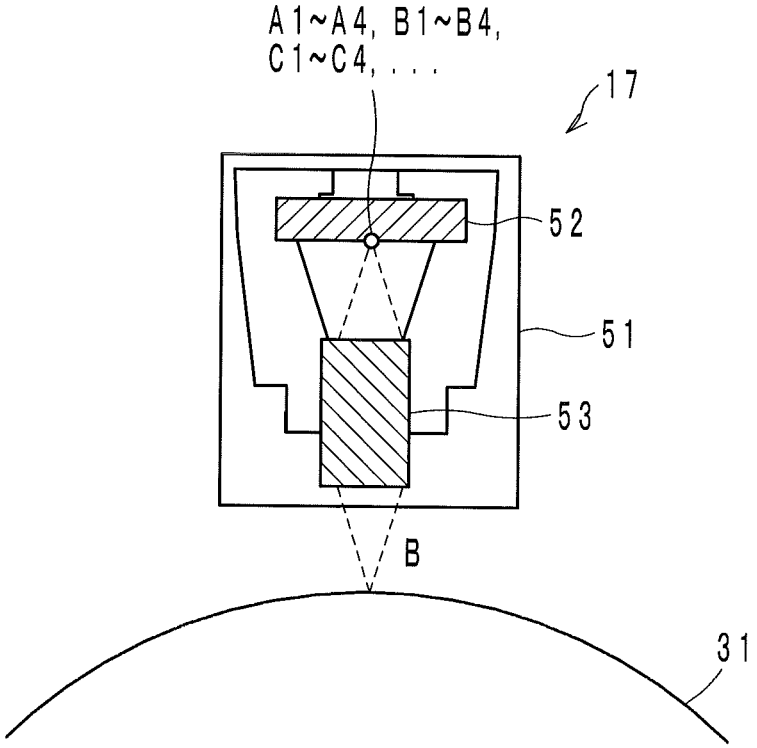
FIG. 2 is an elevational view of an OLED-PH shown in FIG. 1.

The OLED substrate 52, as shown in FIG. 2, supports light-emitting points A1 to A4, B1 to B4, C1 to C4 . . . , of which number is equal to the number of dots in one line in the y-axis direction. (For example, ten thousands and several thousands of light-emitting points are provided).

Figure 3:
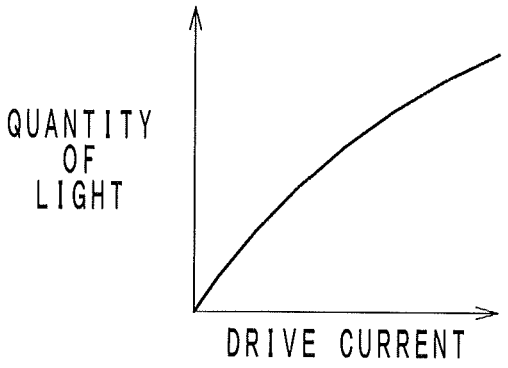
FIG. 3 is a graph showing the quantity of light emitted from a light-emitting point shown in FIG. 2 relative to the drive current supplied to the light-emitting point.

Each of the light-emitting points A1 to A4, B1 to B4, C1 to C4 . . . is typically an OLED, and the light-emitting points A1 to A4, B1 to B4, C1 to C4 . . . are arranged in a line along the y-axis so as to be opposed to the peripheral surface of the corresponding photoreceptor drum 31. The quantity of light emitted from each of the light-emitting points A1 to A4, B1 to B4, C1 to C4 . . . is relative to the drive current input thereto. With respect to each of the light-emitting points A1 to A4, B1 to B4, C1 to C4 . . . , the correlation between the output light quantity and the input drive current is, as shown by FIG. 3, almost linear.

The light-emitting points A1 to A4, B1 to B4, C1 to C4 . . . are supported by one OLED substrate 52. Therefore, the light-emitting points A1 to A4, B1 to B4, C1 to C4 . . . can be produced in one process, and among the light-emitting points A1 to A4, B1 to B4, C1 to C4 . . . , there are substantially no variations in input-output characteristics.

Although each of the light-emitting point A1 to A4, B1 to B4, C1 to C4 . . . is a point light source, the light-emitting points A1 to A4, B1 to B4, C1 to C4 . . . as a whole are configured to scan the light beam B on the peripheral surface of the corresponding photoreceptor drum 31.

The lens array 53 is held by the holder 51 to be opposed to the light-emitting points A1 to A4, B1 to B4, C1 to C4 . . . in the direction of optical axes. The lens array 53 is, for example, a micro lens array (MLA), a light collection transmitter array or the like. Each of the micro lenses or the collection transmitters may be a rod lens with plane end surfaces. Such components are easily processed, and therefore, mass production of the OLED-PHs 17 is easy. The lens array 53 focuses light B emitted from the light-emitting points A1 to A4, B1 to B4, C1 to C4 . . . on the peripheral surface of the corresponding photoreceptor 31.

In the structure above, the peripheral surface of each of the photoreceptor drums 31 can be scanned with a light beam B for the corresponding color in a main-scanning direction (i.e., the y-axis direction). Thereby, on the peripheral surface of each of the photoreceptor drums 31, an electrostatic latent image for the corresponding color is formed.

Each of the developing devices 35 has a developing roller extending in the y-axis direction. The developing roller is opposed to the peripheral surface of the corresponding photoreceptor drum 31, immediately downstream of the exposure position where the photoreceptor drum 31 is exposed to the beam B. In each of the developing devices 35, for example, two-component developer of the corresponding color is contained. Each of the developing devices 35 supplies toner to the peripheral surface of the corresponding photoreceptor drum 31 with the built-in developing roller. Thereby, the electrostatic latent image on each of the photoreceptor drums 31 is developed, and a toner image in the corresponding color (unicolor image) is formed.

Through the process above, each of the photoreceptor drums 31 supports a toner image on its peripheral surface. Also, while rotating in the direction CW, each of the photoreceptor drums 31 carries the toner image downstream in the rotating direction CW.

Each of the transfer devices 19 extends in the y-axis direction and is located immediately downstream of the developing device 35 for the corresponding color. Each of the transfer devices 19 is opposed to the peripheral surface of the corresponding photoreceptor drum 31 via the intermediate transfer belt 21, which will be described below.

The intermediate transfer belt 21 is an endless belt. The intermediate transfer belt 21 is stretched between the driving roller 23 and the driven roller 25 so as to lie between the transfer devices 19 and the photoreceptor drums 31. The intermediate transfer belt 21 is pressed onto the photoreceptor drums 31 by the transfer devices 19. The areas where the intermediate transfer belt 21 is in contact with the photoreceptor drums 31 are referred to as primary transfer areas. The driving roller 23 is rotated by a drive force supplied from a motor (not shown). The driven roller 25 rotates following the rotation of the driving roller 23. Thereby, the intermediate transfer belt 21 rotates in the direction shown by arrow $\alpha$.

A primary transfer bias voltage is applied to each of the transfer devices 19, and thereby, the areas where the transfer devices 19 are in contact with the intermediate transfer belt 21 are charged with an opposite polarity to the toner images. Accordingly, when the toner images carried by the photoreceptor drums 31 reach the primary transfer areas, the toner images move to the outer surface of the intermediate transfer belt 21. Thus, the toner images formed on the photoreceptor drums 31 are transferred to the intermediate transfer belt 21. In the following, the transfer of the toner images to the intermediate transfer belt 21 is referred to as primary transfer.

At this stage, the toner images supported on the respective photoreceptor drums 31 are transferred sequentially on the same area of the intermediate transfer belt 21. By this primary transfer, toner images in the respective colors are combined, thereby resulting in formation of a composite toner image. The intermediate transfer belt 21 supports the composite toner image on its outer surface, and carries the composite toner image to the secondary transfer roller 27 while rotating.

The secondary transfer roller 27 is opposed to the driving roller 23 via the intermediate transfer roller 21 and is pressed by the intermediate transfer belt 21. The area where the intermediate transfer belt 21 is in contact with the secondary transfer roller 27 is hereinafter referred to as a secondary transfer area. As mentioned, the sheet S is fed to and passes through the secondary transfer area, and the composite toner image supported on the intermediate transfer belt 21 is carried to the secondary transfer area. A secondary transfer bias voltage is applied to the secondary transfer roller 27, and thereby, the secondary transfer roller 27, which is located at the back side (non-image-receiving side) of the sheet S, is charged with an opposite polarity to the composite toner image. Accordingly, the composite toner image moves from the outer surface of the intermediate transfer belt 21 to the front side (image-receiving side) of the sheet S. Thus, the composite toner image carried by the intermediate transfer belt 21 is transferred to the sheet S. This image transfer to the sheet S is hereinafter referred to as secondary transfer.

The sheet S that has received the composite toner image is fed to the fixing device 9. The fixing device 9 fixes the composite toner image on the sheet S by heating and pressing the sheet S. The sheet S that has been subjected to the fixing process is ejected through the pair of ejection rollers 11 and is placed on the printed-sheet tray 13.

The devices described above are controlled by the control circuit 37 built in the body of the image forming apparatus 1. The control circuit 37 comprises a CPU, a main memory, etc. and runs in accordance with a prepared program to control printing operation of the image forming apparatus 1 and gain setting/light-quantity adjustment, which will be described later.

OLED-PH According to First Embodiment

According to a first embodiment, gain setting is carried out based on a photodetection signal obtained when the control circuit 37 makes each of the light-emitting points emit light under initial conditions.

Figure 4:
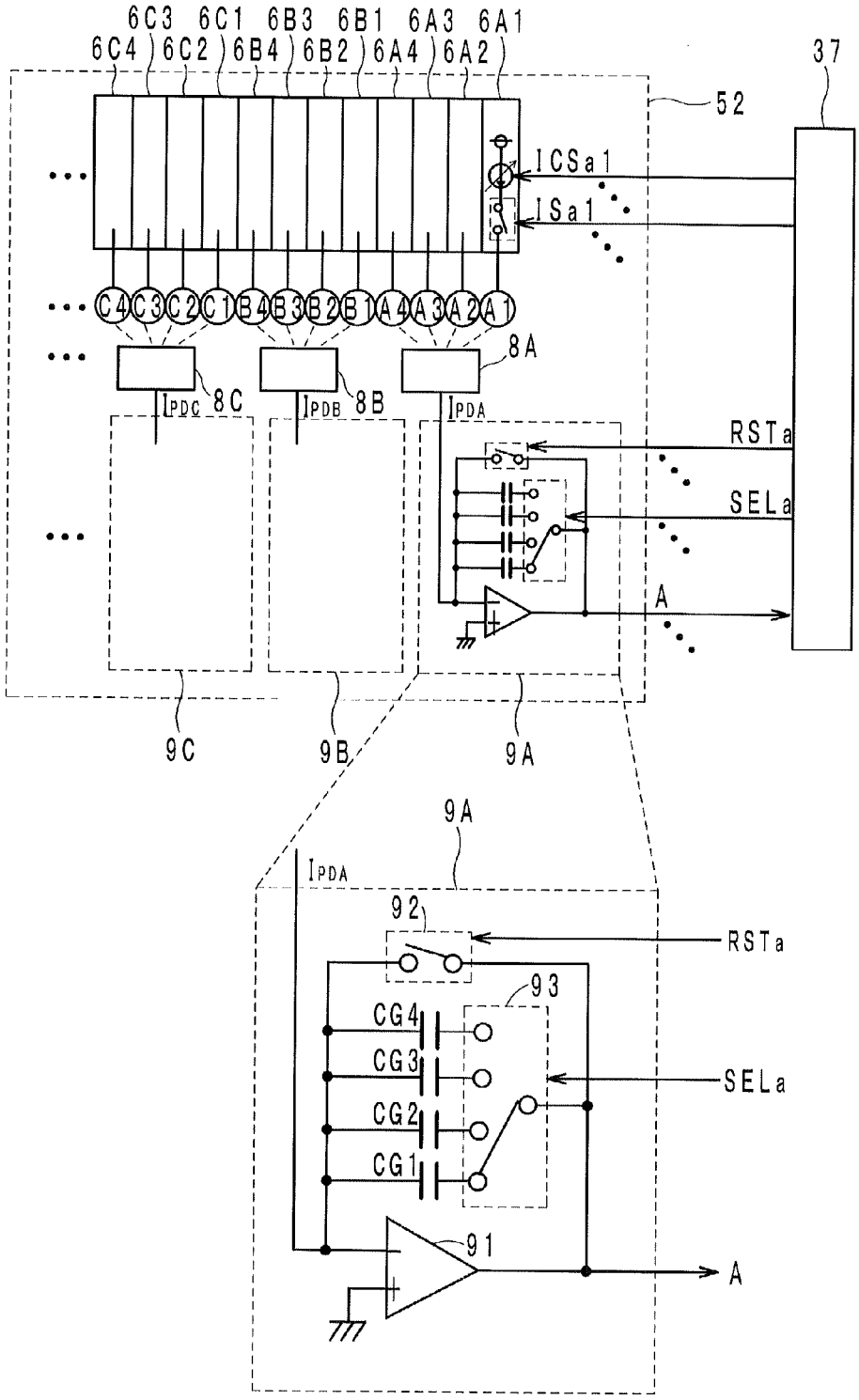
FIG. 4 is a block diagram showing the configuration of an OLED substrate shown in FIG. 2.

The OLED-PHs 17 according to the first embodiment are hereinafter described. On the OLED substrate 52 of each of the OLED-PHs 17, the light-emitting points A1 to A4, B1 to B4, C1 to C4 . . . are divided into a plurality of groups A, B, C . . . as shown in FIG. 4. In this embodiment, the group A includes four light-emitting points A1 to A4. Likewise, each of the groups B, C . . . includes four light-emitting points B1 to B4, C1 to C4 . . . .

In order to carry out light-quantity adjustment, on each of the OLED substrates 52, drive circuits 6A1 to 6A4, 6B1 to 6B4, 6C1 to 6C4 . . . , photodetectors 8A, 8B, 8C . . . , gain switch circuits 9A, 9B, 9C are mounted for the respective groups A, B, C . . . . Thus, in each of the OLED-PHs 17, the light-emitting points and the drive circuits are mounted on a single substrate, and this arrangement permits production of a low-cost optical writing device.

Each of the drive circuits 6A1 to 6A4, 6B1 to 6B4, 6C1 to 6C4 . . . includes a current source and a switch (a switching element such as a TFT). In FIG. 4, however, only the current source and the switch of the drive circuits 6A1 are shown for the sake of expedience.

Current control signals ICSa1 to ICSa4, ICSb1 to ICSb4, ICSc1 to ICSc4 . . . are sent from the control circuit 37 to the current sources of the drive circuits 6A1 to 6A4, 6B1 to 6B4, 6C1 to 6C4 . . . , respectively. In response to the current control signals, the current sources output currents of values depending on the respective current control signals.

Switching signals ISa1 to ISa4, ISb1 to ISb4, ISc1 to ISc4 . . . are sent from the control circuit 37 to the switches of the drive circuits 6A1 to 6A4, 6B1 to 6B4, 6C1 to 6C4 . . . , respectively. In response to the switching signals, the switches are turned on/off depending on the respective switching signals. The switching signals are generated in accordance with image data to be printed out by the image forming apparatus 1.

In this structure, for example, while the current source of the drive circuit 6A1 generates a current based on the current control signal ICSa1, and the switch of the drive circuit 6A1 is kept on based on the switching signal ISa1, the drive circuit 6A1 supplies the current generated by the current source to the light-emitting point A1. Likewise, the other drive circuits 6A2 to 6A4, 6B1 to 6B4, 6C1 to 6C4 . . . supply currents to the respectively corresponding light-emitting points A2 to A4, B1 to B4, C1 to C4 . . . based on the current control signals and the switching signals input thereto.

Figure 5:
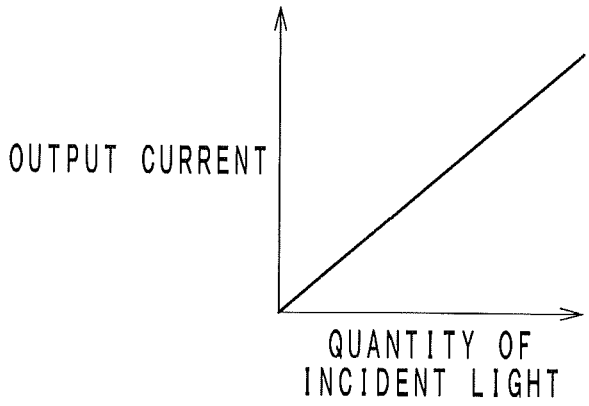
FIG. 5 is a graph showing the output value (output current) from a photodetector shown in FIG. 4 relative to the quantity of light entering thereto.

Each of the photodetectors 8A, 8B, 8C . . . is, for example, a photodiode having a linear input-output characteristic as shown by FIG. 5. The photodetector 8A receives and detects light emitted from the light-emitting points A1 to A4 in the group A, and outputs a current value $I_{PDA}$ in accordance with the quantity of received light to the gain switch circuit 9A. Likewise, the photodetectors 8B, 8C . . . receive and detect light emitted from the light-emitting points B1 to B4, C1 to C4 . . . in the groups B, C . . . , respectively, and output current values $I_{PDB}$, $I_{PDC}$ . . . in accordance with the quantities of received light to the corresponding gain switch circuits 9B, 9C . . . , respectively.

Each of the gain switch circuits 9A, 9B, 9C . . . , as shown by the magnified view at the lower level of FIG. 4, comprises an operational amplifier 91, a plurality of capacitors CG1 to CG4, a first switch 92 and a second switch 93.

An inverted input terminal (−) of the operational amplifier 91 is connected to the photodetector 8A. Also, one ends of the respective capacitors CG1 to CG4 are connected to the inverted input terminal (−). The other ends of the respective capacitors CG1 to CG4 are connected to the second switch 93.

The capacitors CG1 to CG4 are provided for the purpose of gain adjustment and have different capacitance values. In this embodiment, the capacitance values of the capacitors CG1 to CG4 are as follows:

CG1: 1 pF
CG2: 0.5 pF
CG3: 0.25 pF
CG4: 0.125 pF

The second switch 93 is also connected to an output terminal of the operational amplifier 91. The second switch 93 selects one from the capacitors CG1 to CG4 based on a selection signal SELa sent from the control circuit 37, and connects the selected capacitor between the inverted input terminal (−) and the output terminal in parallel.

The first switch 92 is located between the inverted input terminal (−) and the output terminal. The first switch 92 is closed or opened according to a reset signal RSTa sent from the control circuit 37, whereby the drive circuit 9A short-circuits or opens between the inverted input terminal (−) and the output terminal. By the short circuit, the voltages stored in the capacitors CG1 to CG4 are reset to 0V.

A non-inverted input terminal (+) of the operational amplifier 91 is grounded.

The output terminal of the operational amplifier 91 is connected to the control circuit 37. The output voltage $V_{OUT}$ from the operational amplifier 91 is calculated as shown by the following expression (1), wherein the capacitance of the selected capacitor is denoted by $C_S$, the output current from the photodetector 8A is denoted by $I_{PDA}$, and the integral time (light-emitting time of the light-emitting point) is denoted by $T_{PHOTO}$. The output voltage $V_{OUT}$ is detected as a photodetection signal A.

$$V_{OUT}=I_{PDA}\times T_{PHOTO}/C_S \quad (1)$$

The other gain switch circuits 9B, 9C . . . have the same structure and are controlled in the same way as described above, and output photodetection signals B, C . . . are output in accordance with the output currents $I_{PDB}$, $I_{PDC}$ . . . , respectively. For the sake of expedience, FIG. 4 shows the detailed structure of only the gain switch circuit 9A.

In order to improve the detection accuracy of the photodetectors A, B, C . . . it is necessary to heighten the voltages $V_{OUT}$ of the photodetection signals A, B, C . . . , thereby ensuring a sufficient dynamic range. However, for example, the quantity of light incident to the photodetector 8A depends on the quantities of light emitted from the light-emitting points A1 to A4 and other factors. Even if the quantities of light emitted from the light-emitting points A1 to A4 are equal to one another, the output current $I_{PDA}$ from the photodetector 8A may be different for each of the light-emitting points A1 to A4.

Figure 6:
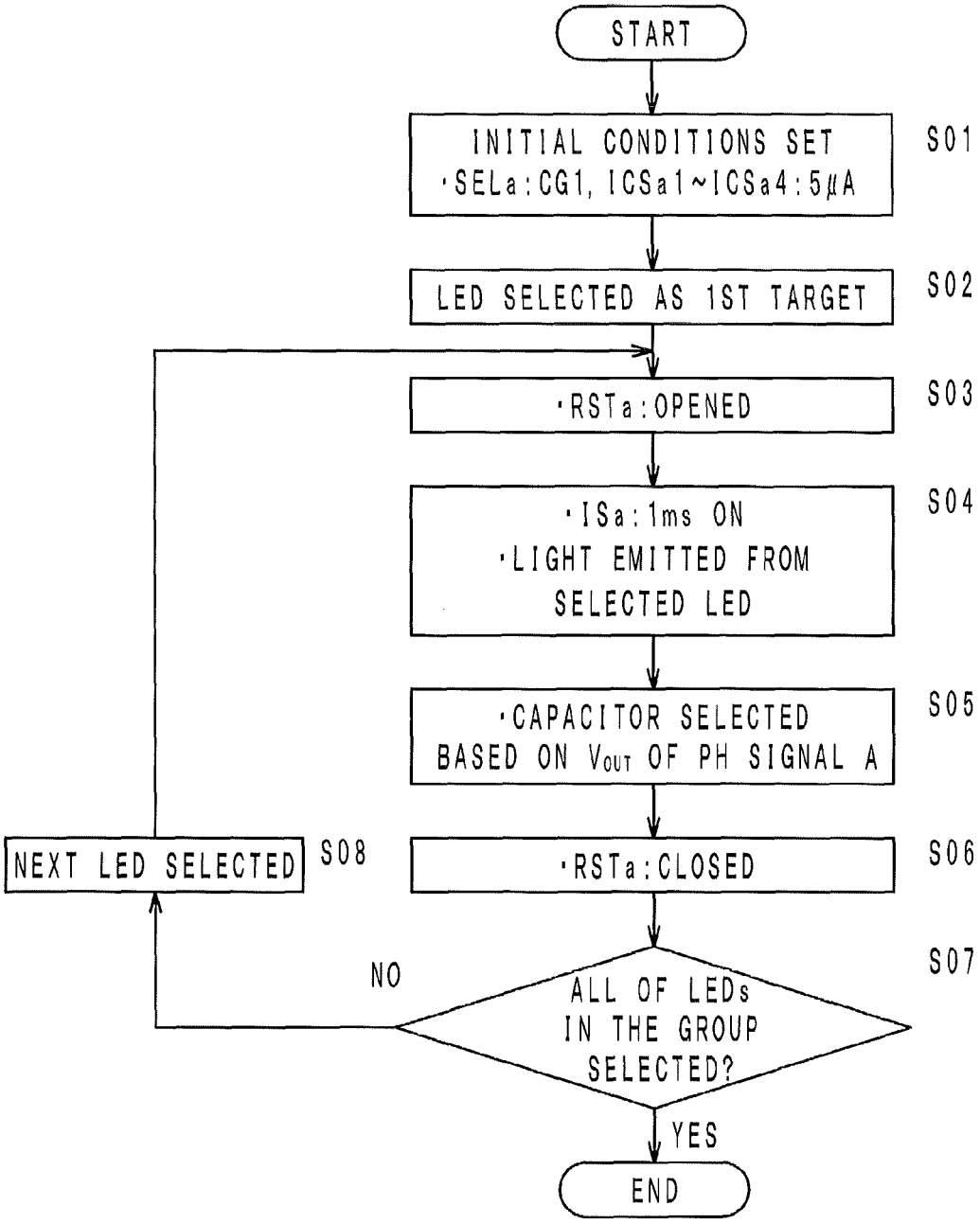
FIG. 6 is a flowchart showing a gain setting process.
Figure 7:
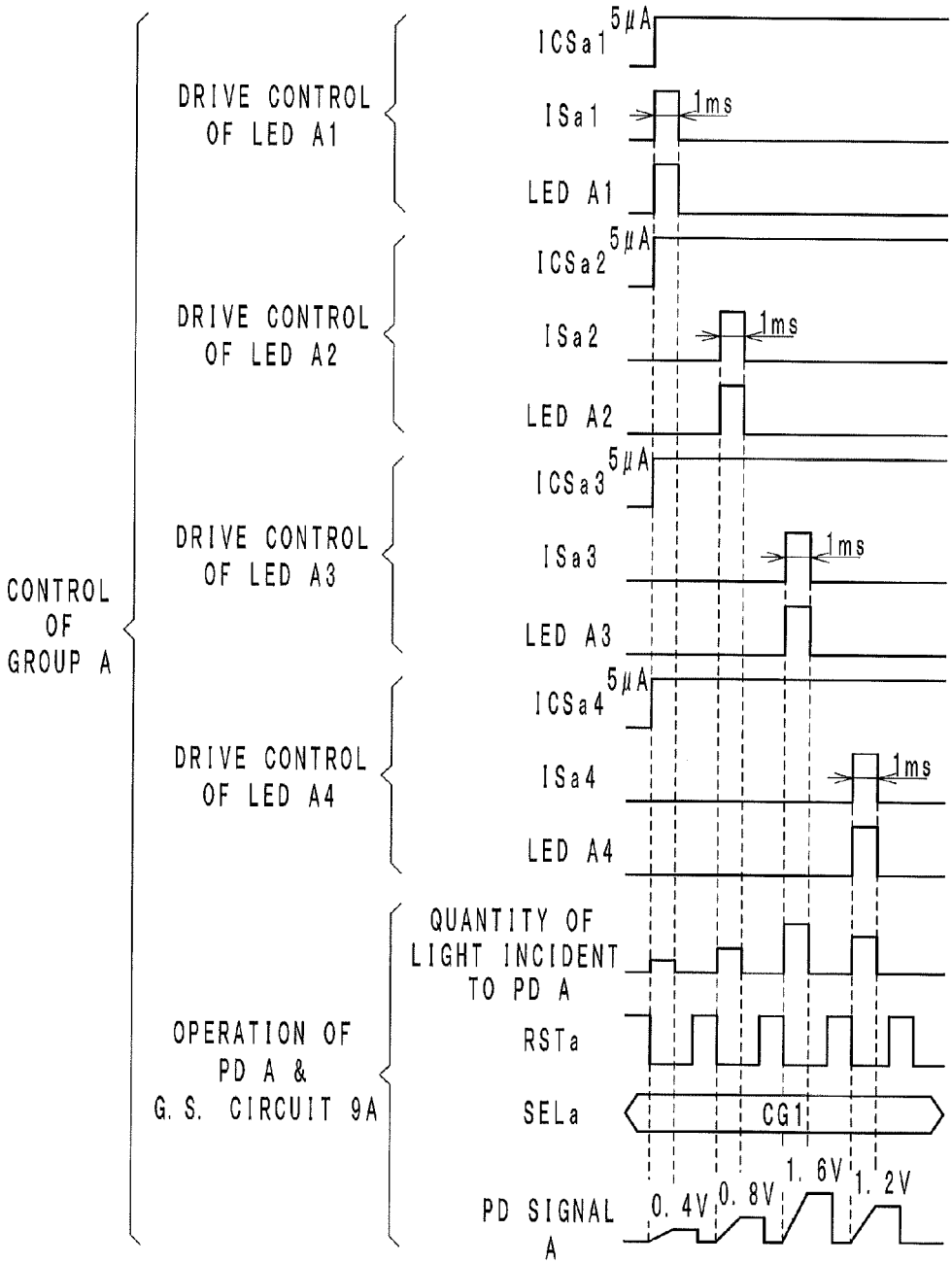
FIG. 7 is a timing chart of the gain setting process.

Therefore, in this embodiment, prior to ordinary optical writing, gain setting, which will be described later with reference to FIGS. 6 and 7, is carried out. In the gain setting process, one of the capacitors CG1 to CG4 is selected in accordance with the quantity of light incident to the photodetector 8A to set a gain fixedly for amplification of the photodetection signal A in regard to each of the light-emitting points A1 to A4. Thereby, a sufficient dynamic range can be ensured. With respect to the other photodetectors 8B, 8C . . . , the same process is carried out.

Gain Setting

First, with reference to FIGS. 6 and 7, a gain setting process used as the basis for light-quantity adjustment is described. FIG. 6 is a flowchart showing the gain setting process. Although FIG. 6 shows only the gain setting process carried out on the group A, the same gain setting process is carried out on the other groups.

In the process shown by FIG. 6, first, initial conditions are set (step S01). Specifically, the control circuit 37 sends the selection signal SELa to the second switch 93 to select one from the capacitors CG1 to CG4. In this embodiment, the capacitor CG1 is selected and connected between the inverted input terminal (−) and the output terminal of the operational amplifier 91. Here, at the initial state, the accumulative light-emitting time of the OLED-PH 17 is almost zero (that is, the OLED-PH 17 has not been used).

The control circuit 37 further sends the current control signals ICSa1 to ICSa4 to set a same drive current value for the light-emitting points A1 to A4. In this embodiment, the drive current value is 5 μA.

At the next step S02, the control circuit 37 selects one from the light-emitting points A1 to A4 as the first target of the process.

At the next step S03, the control circuit 37 sends the reset signal RSTa to open the first switch 92, thereby permitting charge on the capacitor CG1.

At the next step S04, the control circuit 37 sends the switching signal ISa to the drive circuit 6A connected to the targeted light-emitting point 6A to turn on the drive circuit 6A. The drive circuit 6A is kept on for a predetermined time period (for example, 1 ms) to drive the targeted light-emitting point A to emit light for the period. The predetermined time period is a charge time (i.e., integral time) of the capacitor CG1.

The photodetector 8A receives the light emitted from the light-emitting point A and outputs a current value $I_{PDA}$ in accordance with the quantity of the received light. The current value $I_{PDA}$ is sent to the gain switch circuit 9A, whereby the capacitor CG1 is charged for a period of 1 ms. In this period, the gain switch circuit 9A outputs a photodetection signal A relative to the integral of input voltages.

At the next step S05, the control circuit 37 first receives the photodetection signal A in regard to the targeted light-emitting point, the photodetection signal A being relative to the integral time for which the capacitor CG1 was used, and detects the voltage of the light-emitting point.

A table as shown by Table 1 below is preliminarily stored in the control circuit 37.

TABLE 1

| $V_{OUT}$ of Photodetection Signal A | Capacitor to be Selected |
|---|---|
| $0\ V \le V_{OUT} < 0.25\ V$ | CG4: 0.125 pF |
| $0.25\ V \le V_{OUT} < 0.5\ V$ | CG3: 0.25 pF |
| $0.5\ V \le V_{OUT} < 1\ V$ | CG2: 0.5 pF |
| $1\ V \le V_{OUT} < 2\ V$ | CG1: 1 pF |

The table shows a capacitor to be selected (one of the capacitors CG1 to CG4) for each voltage range of the photodetection signal A. In order to ensure a wide dynamic range, as is apparent from the expression (1), it is necessary that the output voltage $V_{OUT}$ in the process of ordinary optical writing is high. Therefore, the table shows a capacitor with a smaller capacitance for a higher voltage $V_{OUT}$ of the photodetection signal A. For example, Table 1 above shows the followings: when the voltage $V_{OUT}$ is equal to or more than 0V and less than 0.25V, the capacitor CG4 (0.125 pF) is selected; when the voltage $V_{OUT}$ is equal to or more than 0.25V and less than 0.5V, the capacitor CG3 (0.25 pF) is selected; when the voltage $V_{OUT}$ is equal to or more than 0.5V and less than 1.0V, the capacitor CG2 (0.5 pF) is selected; and when the voltage $V_{OUT}$ is equal to or more than 1.0V and less than 2.0V, the capacitor CG4 (1 pF) is selected.

When the control circuit 37 detects a voltage of the photodetection signal A in regard to the targeted light-emitting point, the control circuit 37 selects one from the capacitors CG1 to CG4 with reference to the table (step S05).

At the next step S06, the control circuit 37 sends the reset signal RSTa to close the first switch 92 to cause discharge from the capacitor CG1, thereby making the voltage of the capacitor CG1 to 0V.

At the next step S07, the control circuit 37 judges whether all of the light-emitting points A1 to A4 have been selected.

When the control circuit 37 has judged "NO" at step S07, the process goes to step S08. At step S08, the control circuit 37 selects one of the unselected light-emitting points in the group A.

Subsequent to step S08, the process returns to step S03, and the process through the steps S03 to S07 is carried out on the newly selected target.

When the control circuit 37 judges "YES" at step S07, the process shown by FIG. 6 is completed.

Next, referring to the timing chart shown in FIG. 7, a specific example of the gain setting process is described.

First, at step S01 of setting the initial conditions, the control circuit 37 sends the current control signals ICSa1 to ICSa4 to set a same drive current value (in this embodiment, 5 μA) for the light-emitting points A1 to A4. The drive current value is such a value to permit the OLED-PH 17 at the initial stage of use (that is, before deterioration) to emit an adequate quantity of light to the photoreceptor drum 31.

Thereafter, at the first time of coming to step S04, the control circuit 37 outputs the switching signal ISa1 for the first selected light-emitting point A so as to make the light-emitting point A emit light for 1 ms.

The output current $I_{PDA\text{-}A1}$ from the photodetector 8A while the light-emitting point A1 is selected is assumed to be 0.4 nA. The charge time (integral time of the gain switch circuit 9A) $T_{PHOTO}$ is 1 ms. Under these conditions, the voltage $V_{OUT\text{-}A1}$ of the photodetection signal A while the light-emitting point A1 is selected is calculated as shown by the following expression (2).

$$V_{OUT\text{-}A1}=0.4\ nA\times 1\ ms/1\ pF=0.4V \quad (2)$$

At the first time of coming to step S05, with reference to the table, one of the capacitors CG1 to CG4 is selected as the capacitor to be used for ordinary optical writing. In regard to the light-emitting point A1, since the voltage $V_{OUT\text{-}A1}$ is 0.4V, the capacitor CG3 is selected as shown in Table 1.

Thereafter, at step S08, for example, the light-emitting point A2 is selected as the next target. In this case, at the second time of coming to step S04, the switching signal ISa2 is output, whereby the light-emitting point A2 emits light for 1 ms.

The output current $I_{PDA\text{-}A2}$ from the photodetector 8A while the light-emitting point A2 is selected is assumed to be 0.8 nA. The charge time (integral time of the gain switch circuit 9A) $T_{PHOTO}$ is 1 ms. Under these conditions, the voltage $V_{OUT-A2}$ of the photodetection signal A while the light-emitting point A2 is selected is calculated as shown by the following expression (3).

$$V_{OUT-A2}=0.8\text{ nA}\times 1\text{ ms}/1\text{ pF}=0.8\text{V} \quad (3)$$

At the second time of coming to step S05, in regard to the light-emitting point A2, the capacitor CG2 is selected as the capacitor to be used for ordinary optical writing as shown in Table 1.

Thereafter, at step S08, for example, the light-emitting point A3 is selected as the next target. In this case, at the third time of coming to step S04, the switching signal ISa3 is output, whereby the light-emitting point A3 emits light for 1 ms.

The output current $I_{PDA-A3}$ from the photodetector 8A while the light-emitting point A3 is selected is assumed to be 1.6 nA. The charge time (integral time of the gain switch circuit 9A) $T_{PHOTO}$ is 1 ms. Under these conditions, the voltage $V_{OUT-A3}$ of the photodetection signal A while the light-emitting point A3 is selected is calculated as shown by the following expression (4).

$$V_{OUT-A2}=1.6\text{ nA}\times 1\text{ ms}/1\text{ pF}=1.6\text{V} \quad (4)$$

At the third time of coming to step S08, in regard to the light-emitting point A3, the capacitor CG1 is selected as the capacitor to be used for ordinary optical writing as shown in Table 1.

Thereafter, at step S08, for example, the light-emitting point A4 is selected as the next target. In this case, at the fourth time of coining to step S04, the switching signal ISa4 is output, whereby the light-emitting point A4 emits light for 1 ms.

The output current $I_{PDA-A4}$ from the photodetector 8A while the light-emitting point A4 is selected is assumed to be 1.2 nA. The charge time (integral time of the gain switch circuit 9A) $T_{PHOTO}$ is 1 ms. Under these conditions, the voltage $V_{OUT-A4}$ of the photodetection signal A while the light-emitting point A4 is selected is calculated as shown by the following expression (5).

$$V_{OUT-A2}=1.2\text{ nA}\times 1\text{ ms}/1\text{ pF}=1.2\text{V} \quad (5)$$

At the fourth time of coming to step S05, with respect to the light-emitting point A4, the capacitor CG1 is selected as the capacitor to be used for ordinary optical writing as shown in Table 1.

Light-Quantity Adjustment

Figure 8:
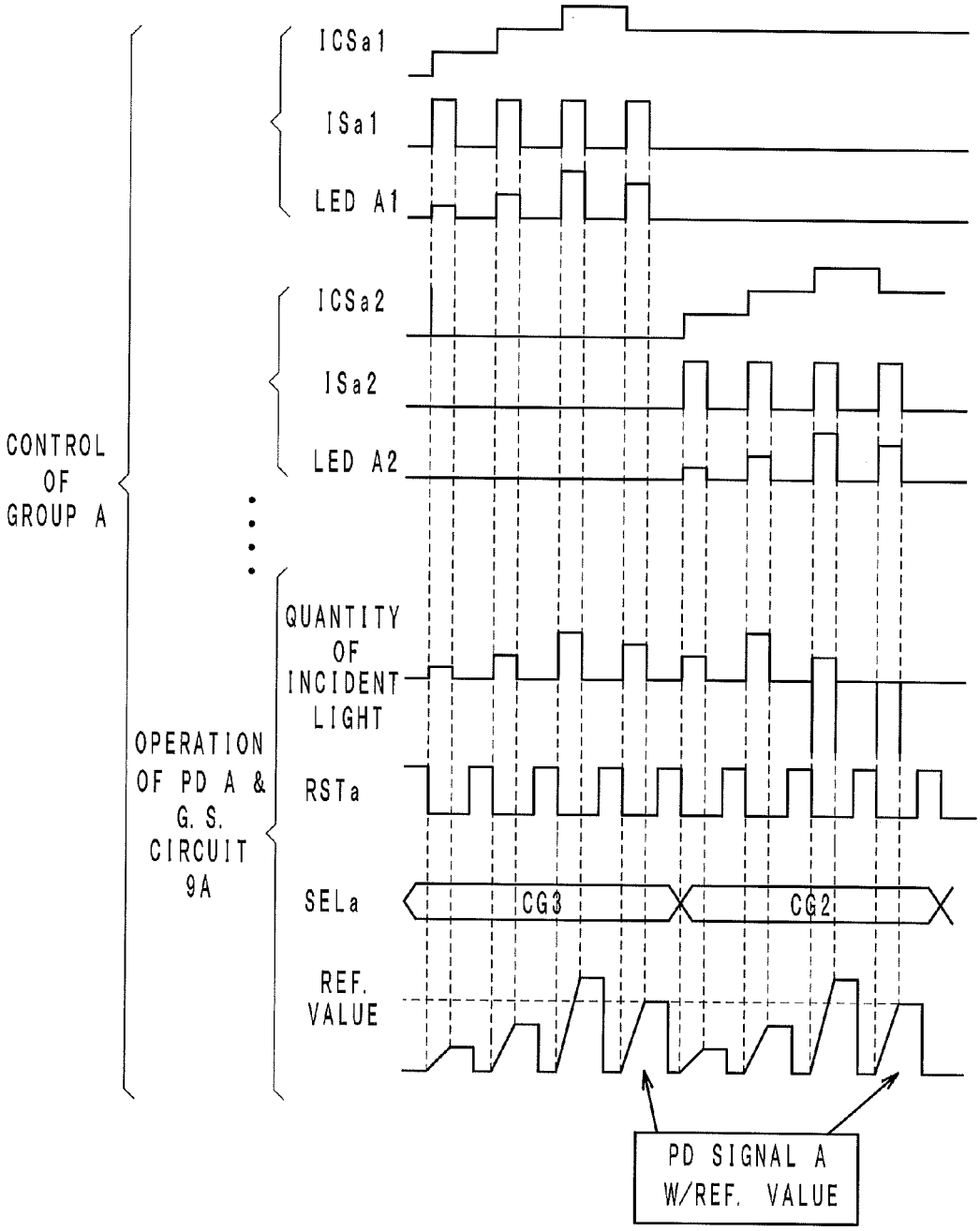
FIG. 8 is a timing chart of a light-quantity adjustment process.

Next, with reference to FIG. 8, the light-quantity adjustment is described. In order to detect the quantity of light emitted from the light-emitting point A1, the control circuit 37 sends the selection signal SELa to the second switch 93 to fixedly set the capacitor CG3 that was selected in the gain setting process that was carried out by use of the OLED-PH 17 at the initial stage of use (before degradation).

Next, the control circuit 37 outputs the current control signal ICSa1 so as to raise the drive current generated by the current source of the drive circuit 6A1 step by step. In the meantime, the control circuit 37 intermittently repeats a control process of outputting the reset signal RSTa to turn the first switch 92 from on to off and of outputting the switching signal ISa to turn the switch from off to on. Thereby, the light-emitting point A1 emits a quantity of light in accordance with the drive current, and the current $I_{PDA}$ is supplied to the gain switch circuit 9A. Accordingly, a voltage is applied to the input terminal of the gain switch circuit 9A. The gain switch circuit 9A amplifies the voltage applied thereto with a gain depending on the selected capacitor CG3 and outputs the amplified voltage as the photodetection signal A. The control circuit 37 adjusts the drive current generated by the current source of the drive circuit 6A1 such that the voltage of the photodetection signal A will be a reference value predetermined for the light-emitting points A. This light-quantity adjustment process is carried out on the other light-emitting points A2 to A4 in the group A and also on the light-emitting points in the other groups B, C . . . .

Now, the reference value predetermined for the light-emitting points A is described in more detail. The output value of the photodetection signals A immediately after the selection of the capacitors at step S05 shown in FIG. 6 in regard to the respective light-emitting points A is stored in a memory of the control circuit 37, and this value is used as the reference value for the light-emitting points A. More specifically, capacitors are selected for the respective light-emitting points A while the light-emitting points A are driven one by one to emit light under the initial conditions (under conditions of using an OLED-PH 17 at the initial stage of use (before degradation) and of supplying all of the light-emitting points of the OLED-PH 17 with drive currents of the same value), and the value of the photodetection signals A obtained by amplification with gains by using the selected capacitors for the respective light-emitting points A is used as the reference value (reference output voltage value) for the light-emitting points A.

The description of this embodiment has been given with reference to the gain setting flow shown in FIG. 6 and an example where the light-emitting points A are supplied with drive currents of the same fixed value to obtain the reference value for the light-emitting points A. However, the present invention is not limited to the example. At the time of manufacture, each of the light-emitting points A may be driven to emit light, and the quantity of light at a position corresponding to the photoreceptor 31 may be measured by use of a measuring device such as an optical power meter or the like. Then, a drive current value that was adjusted to permit an appropriate exposure value may be used.

Also, the memory may be mounted on the substrate of the OLED-PH 17. In a case where the gain setting flow shown by FIG. 6 and determination of the reference value are carried out before the OLED-PH 17 is set in the body of the image forming apparatus, the set values shall be stored in the memory mounted on the substrate of the OLED-PH 17, and after the OLED-PH 17 is set in the apparatus, the control circuit 37 in the body of the image forming apparatus can read the set values from the memory.

Advantageous Effects of the First Embodiment

As described above, in the first embodiment, the gain setting process is carried out before the light-quantity adjustment process. Thereby, an appropriate capacitor for each of the light-emitting points A1 to A4, B1 to B4, C1 to C4 . . . is selected fixedly. With respect to the group A, in order to ensure a sufficient dynamic range, in the gain setting process, a capacitor with a smaller capacitance is selected when the voltage $V_{OUT}$ of the photodetection signal A is smaller. In the light-quantity adjustment of each of the light-emitting points, the selected capacitor is used, and therefore, the voltage of the photodetection signal A even in regard to a light-emitting point emitting a smaller quantity of light can be great. This also applies to the other groups B, C . . . . By carrying out the gain setting process and the light-quantity adjustment process in this order, it is possible to provide a high-precision OLED- PH 17 with high detection accuracy and an image forming apparatus 1 comprising the high-precision OLED-PH 17.

Notes

In the embodiment above, the gain switch circuit 9A has four capacitors CG1 to CG4. However, any number of capacitors may be provided in the gain switch circuit 9A as long as the capacitors are two or more capacitors having different capacitance values.

The capacitor CG1 may comprise a plurality of capacitor elements. This also applies to the other capacitors CG2 to CG4.

In the embodiment above, each group has four light-emitting points. However, the number of light-emitting points in each group is not limited to four, and it is only necessary that each group has two or more light-emitting points.

Second Embodiment

Next, an OLED-PH 17 according to a second embodiment is described. The second embodiment is different from the first embodiment in that gain setting on the OLED-PH 17 according to the second embodiment is not carried out by the control circuit 37 but was completed preliminarily. There is no other difference between the first embodiment and the second embodiment. The same components of the OLED-PH 17 according to the second embodiment as those of the OLED-PH 17 according to the first embodiment are provided with the same reference marks as the components of the OLED-PH 17 according to the first embodiment, and descriptions of these components are omitted.

As is apparent from FIG. 4, for example, the distances between the photodetector 8A and the respective light-emitting points A1 to A4 in the group A may be different. In this case, even when the quantities of light emitted from the respective light-emitting points A1 to A4 are equal to one another, the quantities of light entering from the respective light-emitting points A1 to A4 to the photodetector 8A are different. This is attributed to the fact that light emitted from each of the light-emitting points A1 to A4 diverges. Accordingly, the quantity of light entering to the photodetector 8A from a farther light-emitting point is smaller.

The distances between the photodetector 8A and the respective light-emitting points A1 to A4 in the group A might become known at the time of design of the OLED-PH 17. In this case, selection of a capacitor for each of the light-emitting points may be carried out preliminarily in a gain setting process as will be described below.

For example, the distances D1 to D4 between the photodetector 8A and the respective light-emitting points A1 to A4 are supposed to be as follows:

D1: 200 μm
D2: 100 μm
D3: 50 μm
D4: 75 μm

For a light-emitting point located farther from the photodetector 8A, a capacitor with a smaller capacitance value is selected because the quantity of light entering from the light-emitting point to the photodetector 8A will be smaller. On the contrary, for a light-emitting point located closer to the photodetector 8A, a capacitor with a greater capacitance value is selected because the quantity of light entering from the light-emitting point to the photodetector 8A will be greater. On the basis of this way of thinking, the selection of a capacitor for each of the light-emitting points is carried out with reference to a table as shown by Table 2 below.

TABLE 2

| Distance D | Capacitor to be Selected |
|---|---|
| 400 μm ≤ D | CG4: 0.125 pF |
| 200 μm ≤ D < 400 μm | CG3: 0.25 pF |
| 100 μm ≤ D < 200 μm | CG2: 0.5 pF |
| D < 100 μm | CG1: 1 pF |

According to Table 2 above, the capacitor CG3 is selected as the capacitor to be used for the light-emitting point A1 during ordinary optical writing. For the light-emitting points A2, A3 and A4, the capacitors CG2, CG1 and CG1 are selected respectively. In regard to the other groups, the selection of capacitors is carried out in the same manner.

As a description of the second embodiment, a description of the gain setting process and the light-quantity adjustment process on the group A have been given. Further, the other groups are also subjected to the same gain setting process and the same light-quantity adjustment process.

Advantageous Effects of the Second Embodiment

The second embodiment brings the same effects as the first embodiment. In the second embodiment, further, it is possible to fixedly set a capacitor for each of the light-emitting points at the time of design of the OLED-PH 17 based on the distance between the photodetector and each of the light-emitting points. Therefore, it is not necessary that the control circuit 37 carries out the gain setting process, and it is possible to reduce the burden on the control circuit 37.

Third Embodiment

Next, an OLED-PH 17 according to a third embodiment is described. The third embodiment is different from the first embodiment in that gain setting on the OLED-PH 17 according to the second embodiment is not carried out by the control circuit 37 but was completed preliminarily. There is no other difference between the first embodiment and the third embodiment. The same components of the OLED-PH 17 according to the third embodiment as those of the OLED-PH 17 according to the first embodiment are provided with the same reference marks as the components of the OLED-PH 17 according to the first embodiment, and descriptions of these components are omitted.

In order to form a high-quality electrostatic latent image on the peripheral surface of the photoreceptor drum 31, for example, in regard to the group A, it is preferred that the quantities of light emitted from the light-emitting points A1 to A4 and received on the peripheral surface of the photoreceptor drum 31 are equal to one another.

Figure 9:
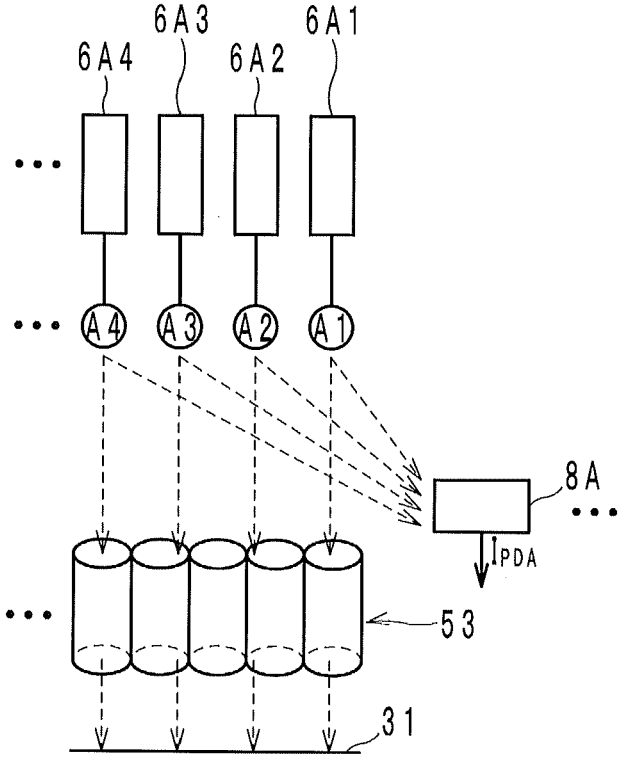
FIG. 9 is a schematic view of a rod lens array.

As mentioned above, the OLED-PH 17 has the lens array 53 located between the light-emitting points A1 to A4 and the photoreceptor drum 13. The lens array 53 may be, as shown in FIG. 9, a rod lens array. When a rod lens array is used as the lens array 53, in most cases, the transmittance of light through the rod lens array differs depending on from which of the light-emitting points A1 to A4 the light is emitted. Accordingly, even when the light-emitting points A1 to A4 emit the same quantity of light, the quantity of light detected on the peripheral surface of the photoreceptor drum 31 differs among the light-emitting points A1 to A4. This is a cause of deterioration of an electrostatic latent image formed on the photoreceptor drum 31. In this case, also, the quantity of light entering to the photodetector 8A differs among the light-emitting points A1 to A4. In the third embodiment, in regard to the light-emitting points A1 to A4, in order to even out the quantity of light received on the peripheral surface of the photoreceptor drum 30, gain setting is carried out considering the transmittance of light through the rod lens array.

Light entering to the vicinity of the central axis of a rod lens is transmitted typically at a high transmittance. Therefore, a light-emitting point that emits light to pass through the vicinity of the central axis of a rod lens needs to emit only a relatively small quantity of light. On the other hand, light entering to the periphery of a rod lens is transmitted typically at a low transmittance because the light refracts in the rod lens repeatedly while passing through the peripheral of the rod lend. Therefore, a light-emitting point that emits light to pass through the periphery of a rod lens preferably emits a relatively large quantity of light.

The positional relation between the respective light-emitting points A1 to A4 and the lens array 53 is not changeable but fixed. Therefore, at the time of design of the OLED-PH 17, the optical transmittance of the lens array 53 for light emitted from each of the light-emitting points A1 to A4 becomes known. In this case, selection of capacitors for the respective light-emitting points may be carried out preliminarily in a gain setting process as will be described below.

For example, the transmitting position of a rod lens and the transmittance through the rod lens for light emitted from each of the light-emitting points A1 to A4 are supposed to be as follows. For light emitted from the light-emitting point A1, the transmitting position is near the central axis of a rod lens, and the transmittance T1 is 80%. For light emitted from the light-emitting point A2, the transmitting position is in the periphery of a rod lens, and the transmittance T2 is 40%. For light emitted from the light-emitting point A3, the transmitting position is in the periphery of a rod lens, and the transmittance T3 is 40%. For light emitted from the light-emitting point A4, the transmitting position is near the central axis of a rod lens, and the transmittance T4 is 80%.

As described above, a light-emitting point that emits light to be transmitted by the lens array 53 at a high transmittance needs to emit only a small quantity of light to the photodetector, and for the light-emitting point, a capacitor with a relatively small capacitance value is selected. On the other hand, a light-emitting point that emits light to be transmitted by the lens array 53 at a low transmittance needs to emit a large quantity of light to the photodetector, and for the light-emitting point, a capacitor with a relatively large capacitance value is selected. On the basis of this way of thinking, the selection of a capacitor for each of the light-emitting points is carried out with reference to a table as shown by Table 3 below.

TABLE 3

| Transmittance T | Capacitor to be Selected |
|---|---|
| 93.75% ≤ T | CG4: 0.125 pF |
| 87.5% ≤ T < 93.75% | CG3: 0.25 pF |
| 75.0% ≤ T < 87.5% | CG2: 0.5 pF |
| T < 75.0% | CG1: 1 pF |

According to Table 3 above, the capacitor CG2 is selected as the capacitor to be used for the light-emitting point A1 during ordinary optical writing. For the light-emitting points A2, A3 and A4, the capacitors CG1, CG1 and CG2 are selected respectively. In regard to the other groups, the selection of capacitors is carried out in the same manner.

The results of the capacitor selection carried out in the above-described way are written in a light-quantity adjustment program to be carried out by the control circuit 37. Thereby, a capacitor is fixedly set for each of the light-emitting points. The control circuit 37 carries out the light-quantity adjustment as described above by following this program.

Advantageous Effects of the Third Embodiment

The third embodiment brings the same effects as the first embodiment. In the third embodiment, further, it is possible to fixedly set a capacitor for each of the light-emitting points at the time of design of the OLED-PH 17 based on the transmittance through the lens array 53. Therefore, it is not necessary that the control circuit 37 carries out the gain setting process, and it is possible to reduce the burden on the control circuit 37.

Fourth Embodiment

Next, an OLED-PH 17 according to a fourth embodiment is described. The fourth embodiment is different from the first embodiment in that gain setting on the OLED-PH 17 according to the second embodiment is not carried out by the control circuit 37 but was completed preliminarily. There is no other difference between the first embodiment and the fourth embodiment. The same components of the OLED-PH 17 according to the fourth embodiment as those of the OLED-PH 17 according to the first embodiment are provided with the same reference marks as the components of the OLED-PH 17 according to the first embodiment, and descriptions of these components are omitted.

In the second embodiment, the criteria for selecting a capacitor for each of the light-emitting points is the distance between each of the light-emitting point and the photodetector 8A. In the third embodiment, the criteria for selecting a capacitor for each of the light-emitting points is the transmittance of light emitted from each of the light-emitting point through the rod lens array. In the fourth embodiment, in order to take both the distance and the transmittance into consideration, the value calculated by distance (D)×transmittance (T) is defined as an index (X).

The distances D1 to D4 between the respective light-emitting points A1 to A4 and the photodetector 8A are, for example, as follows.

Distance D1: 200 μm
Distance D2: 100 μm
Distance D3: 50 μm
Distance D4: 75 μm The transmittances T1 to T4 of light emitted from the respective light-emitting points A1 to A4 through the rod lens array are, for example, as follows.

Transmittance T1: 80%
Transmittance T2: 40%
Transmittance T3: 40%
Transmittance T4: 80%

In the example above, the indexes X1 to X4 for the respective light-emitting points A1 to A4 are as follows.

Index X1=D1×T1=160
Index X2=D2×T2=40
Index X3=D3×T3=20
Index X4=D4×T4=60

As described in connection with the second embodiment, for a light-emitting point at a larger distance from the photodetector 8A, a capacitor with a smaller capacitance is selected. As described in connection with the third embodiment, for a light-emitting point that emits light to be transmitted at a higher transmittance, a capacitor with a smaller capacitance is selected. Accordingly, in the fourth embodiment, for a light-emitting point having a greater index X, a capacitor with a smaller capacitance is selected. On the basis of this way of thinking, the selection of capacitors for the respective light-emitting points is carried out with reference to a table as shown by Table 4 below.

TABLE 4

| Index X (D × T) | Capacitor to be Selected |
|---|---|
| 400 ≤ X | CG4: 0.125 pF |
| 200 ≤ X < 400 | CG3: 0.25 pF |
| 100 ≤ X < 200 | CG2: 0.5 pF |
| T < 100 | CG1: 1 pF |

According to Table 4, for the light-emitting points A1, A2, A3 and A4, the capacitors CG2, CG1, CG1 and CG1 are selected respectively. In regard to the other groups, the selection of capacitors is carried out in the same manner.

The results of the capacitor selection carried out in the above-described way are written in a light-quantity adjustment program to be carried out by the control circuit 37. Thereby, a capacitor is fixedly set for each of the light-emitting points. The control circuit 37 carries out the light-quantity adjustment as described above by following this program.

First Modification

In the embodiments described above, each of the gain switch circuits 9A has a parallel circuit including four capacitors respectively located in four branches. Such a structure of each of the gain switch circuits 9A wherein a capacitor is located in each of the branches is complicating, and this increases the cost for producing the gain switch circuits 9A. In order to avoid this problem, each of the gain switch circuits 9A may be replaced by a circuit shown by FIG. 10 having a capacitor CG1 in a single branch.

Figure 10:
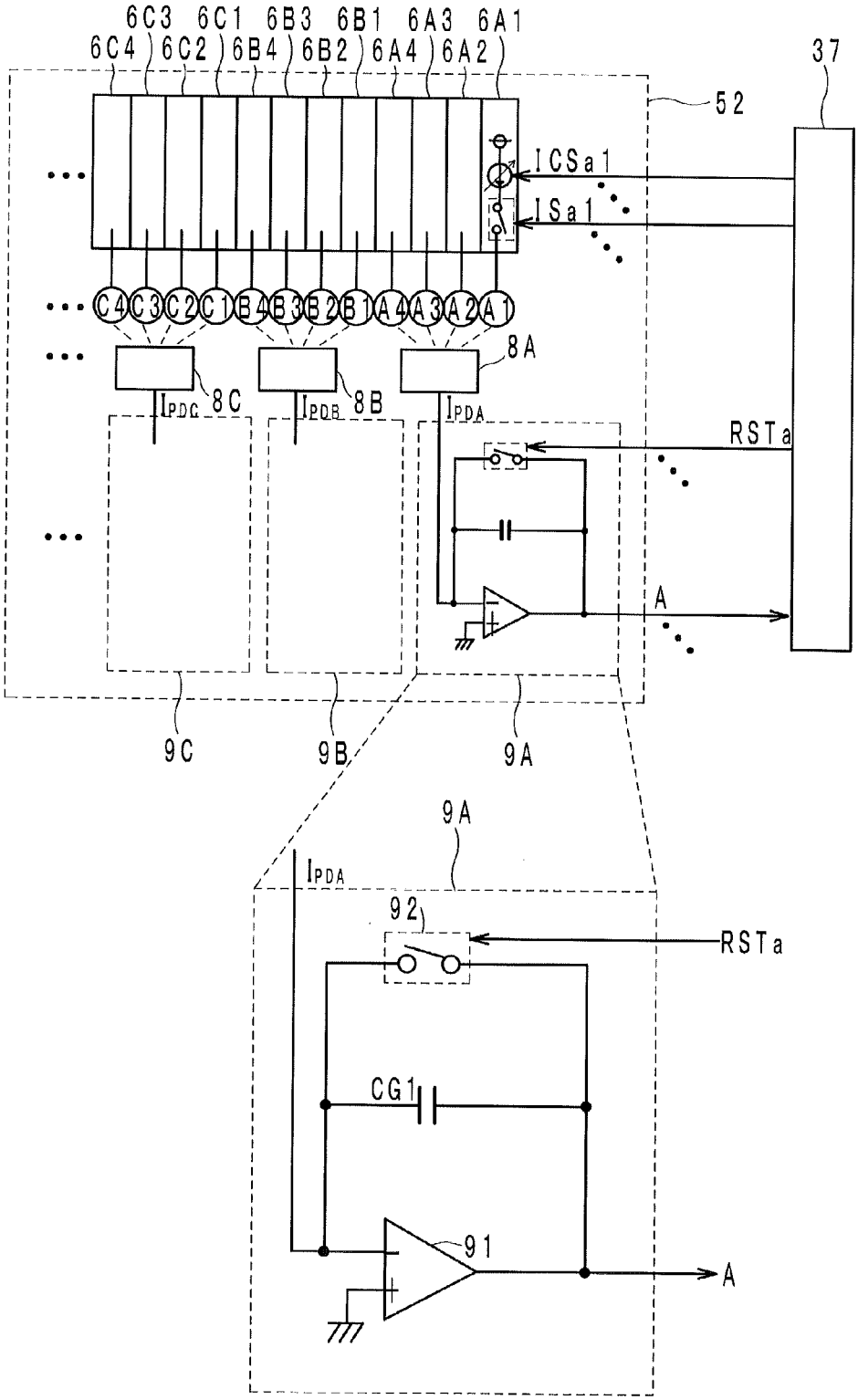
FIG. 10 is a gain switching circuit according to a first modification.

In each of the gain switch circuits 9A structured as shown by FIG. 10, also, the output voltage $V_{OUT}$ from the operational amplifier 91 (the voltage of the photodetection signal) is expressed by the following expression (6), wherein the capacitance of the capacitor CG1 is denoted by $C_S$, the output current from the photodetector 8A is denoted by $I_{PDA}$, and the integral time (light-emitting time of the light-emitting point) is denoted by $T_{PHOTO}$.

$$V_{OUT}=I_{PDA}\times T_{PHOTO}/C_S \quad (6)$$

As is apparent from the expression (6), the gain of the output voltage $V_{OUT}$, can be changed by changing the value $T_{PHOTO}$ even without switching among the capacitors CG1 to CG4 having different capacitance values. Accordingly, the control circuit 37 stores tables as shown by Tables 5 to 8 below instead of Tables 1 to 4, and in the gain setting process, the control circuit 37 sends a switching signal ISa indicating an appropriate integral time $T_{PHOTO}$ to each of the drive circuits 6A.

TABLE 5

| $V_{OUT}$ of Photodetection Signal A | Integral Time $T_{PHOTO}$ |
|---|---|
| 0 V ≤ $V_{OUT}$ < 0.25 V | 8 ms |
| 0.25 V ≤ $V_{OUT}$ < 0.5 V | 4 ms |
| 0.5 V ≤ $V_{OUT}$ < 1 V | 2 ms |
| 1 V ≤ $V_{OUT}$ < 2 V | 1 ms |

TABLE 6

| Distance D | Integral Time $T_{PHOTO}$ |
|---|---|
| 400 μm ≤ D | 8 ms |
| 200 μm ≤ D < 400 μm | 4 ms |
| 100 μm ≤ D < 200 μm | 2 ms |
| D < 100 μm | 1 ms |

TABLE 7

| Transmittance T | Integral Time $T_{PHOTO}$ |
|---|---|
| 93.75% ≤ T | 8 ms |
| 87.5% ≤ T < 93.75% | 4 ms |
| 75.0% ≤ T < 87.5% | 2 ms |
| T < 75.0% | 1 ms |

TABLE 8

| Index X (D × T) | Integral Time $T_{PHOTO}$ |
|---|---|
| 400 ≤ X | 8 ms |
| 200 ≤ X < 400 | 4 ms |
| 100 ≤ X < 200 | 2 ms |
| T < 100 | 1 ms |

By adopting the structure and the control method above, it is possible to simplify the structure of the gain switch circuit 9A, thereby reducing the cost for producing the gain switch circuit 9A. Thus, the voltage of the photodetection signal A can be amplified by adjusting the integral time $T_{PHOTO}$, and therefore, like in the embodiments above, light-quantity detection can be carried out with a high degree of accuracy.

Second Modification

In the embodiments above, each of the gain switch circuits 9A shown by FIG. 4 has a problem that it takes time for charging the capacitors. In order to avoid the problem, each of the gain switch circuits 9A may be replaced by a circuit shown by the magnified view at the lower level of FIG. 11. The circuit shown by the magnified view in FIG. 11 comprises an operational amplifier 91, a plurality of resistors RG1 to RG4, and a switch 93.

Figure 11:
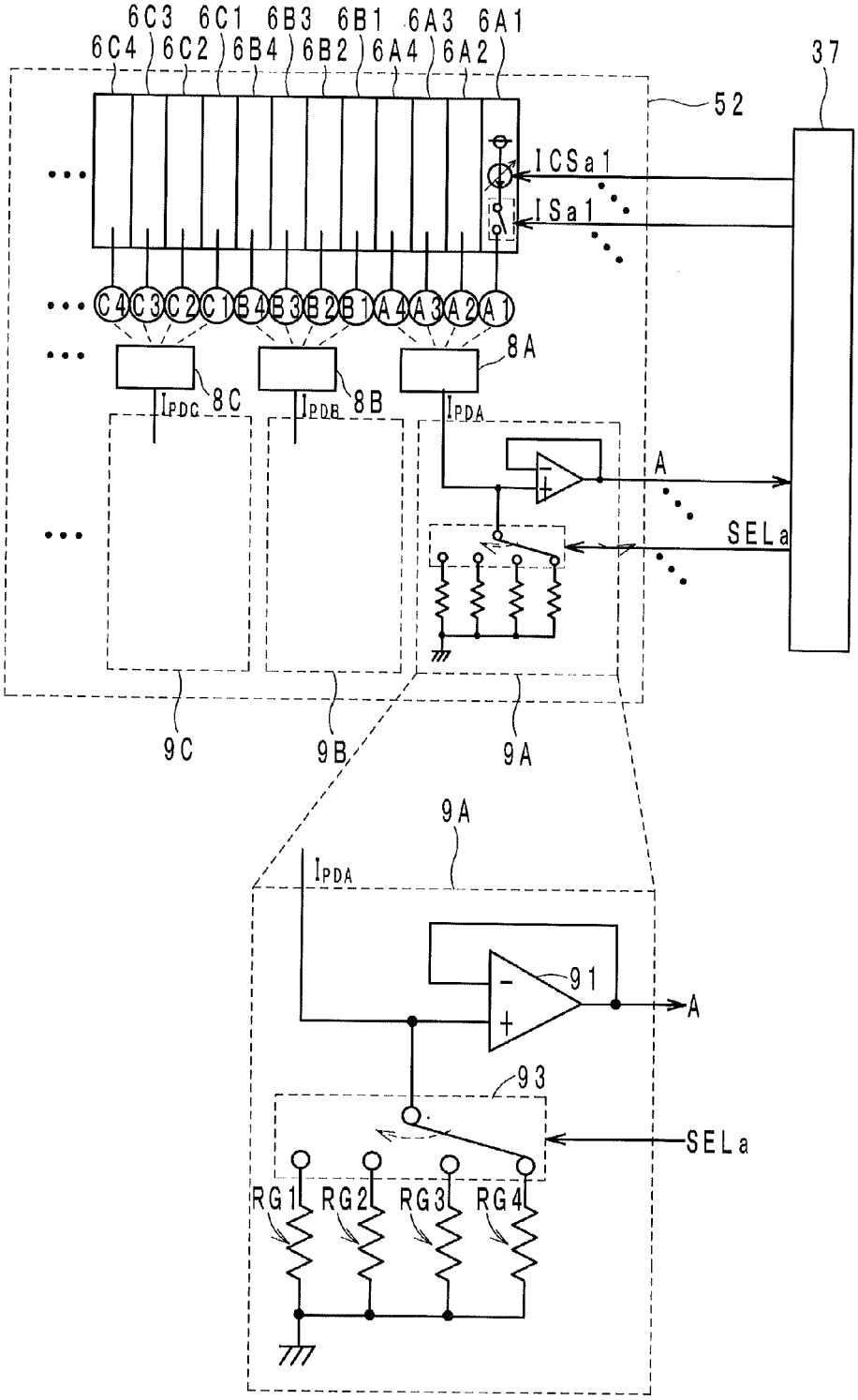
FIG. 11 is a gain switching circuit according to a second modification.

In the gain switch circuit shown in FIG. 11, the photodetection signal A output from the operational amplifier 91 is sent to the inverted input terminal (−) of the operational amplifier 91. The switch 93 is connected to one of the resistors RG1 to RG4 in accordance with a selection signal SELa sent thereto, and thereby, the selected resistor is connected between the output terminal for outputting the current value $I_{PDA}$ and the non-inverted input terminal (+) of the operational amplifier 91 in parallel to the output terminal for outputting the current value $I_{PDA}$.

The resistors RG1 to RG4 are provided for gain adjustment, and the resistors RG1 to RG4 have different resistance values. In this embodiment, the resistance values of the resistors RG1 to RG4 are as follows.

RG1: 1 GΩ
RG2: 2 GΩ
RG3: 4 GΩ
RG4: 8 GΩ

The output terminal of the operational amplifier 91 is connected to the control circuit 37. The output voltage \Tour from the operational amplifier 91 is calculated by use of the following expression (1), wherein the resistance value of a selected resistor is denoted by RG, the output current from the photodetector 8A is denoted by $I_{PDA}$. The calculation result is output as a photodetection signal A.

$$V_{OUT}=I_{PDA}\times T_{PHOTO}/C_S \quad (7)$$

The other gain switch circuits 9B, 9C . . . are of the same structure as the gain switch circuit 9A and carry out the same control as the gain switch circuit 9A. Accordingly, the gain switch circuits 9B, 9C . . . output photodetection signals B, C . . . in accordance with input currents $I_{PDB}$, $I_{PDC}$ . . . , respectively. For the sake of expedience, FIG. 11 shows the details of only the gain switch circuit 9A.

As is apparent from the expression (7), the gain of the output voltage $V_{OUT}$ can be changed by switching among the resistors RG1 to RG4 having different resistance values. Accordingly, the control circuit 37 stores tables as shown by Tables 9 to 12 below instead of Tables 1 to 4, and in the gain setting process, the control circuit 37 sends a selection signal SELa indicating an appropriate resistor to the switch 93.

TABLE 9

| $V_{OUT}$ of Photodetection Signal A | Resistor to be Selected |
|---|---|
| $0\ V \le V_{OUT} < 0.25\ V$ | RG4: 8 GΩ |
| $0.25\ V \le V_{OUT} < 0.5\ V$ | RG3: 4 GΩ |
| $0.5\ V \le V_{OUT} < 1\ V$ | RG2: 2 GΩ |
| $1\ V \le V_{OUT} < 2\ V$ | RG1: 1 GΩ |

TABLE 10

| Distance D | Resistor to be Selected |
|---|---|
| 400 μm ≤ D | RG4: 8 GΩ |
| 200 μm ≤ D < 400 μm | RG3: 4 GΩ |
| 100 μm ≤ D < 200 μm | RG2: 2 GΩ |
| D < 100 μm | RG1: 1 GΩ |

TABLE 11

| Transmittance T | Resistor to be Selected |
|---|---|
| 93.75% ≤ T | RG4: 8 GΩ |
| 87.5% ≤ T < 93.75% | RG3: 4 GΩ |
| 75.0% ≤ T < 87.5% | RG2: 2 GΩ |
| T < 75.0% | RG1: 1 GΩ |

TABLE 12

| Index X (D × T) | Resistor to be Selected |
|---|---|
| 400 ≤ X | RG4: 8 GΩ |
| 200 ≤ X < 400 | RG3: 4 GΩ |
| 100 ≤ X < 200 | RG2: 2 GΩ |
| T < 100 | RG1: 1 GΩ |

By adopting the structure and the control method above, it is possible to amplify the voltage of the photodetection signal A while making the gain switch circuit 9A operate faster. Therefore, like in the embodiments above, light-quantity detection can be carried out with a high degree of accuracy.

Third Modification

Figure 12:
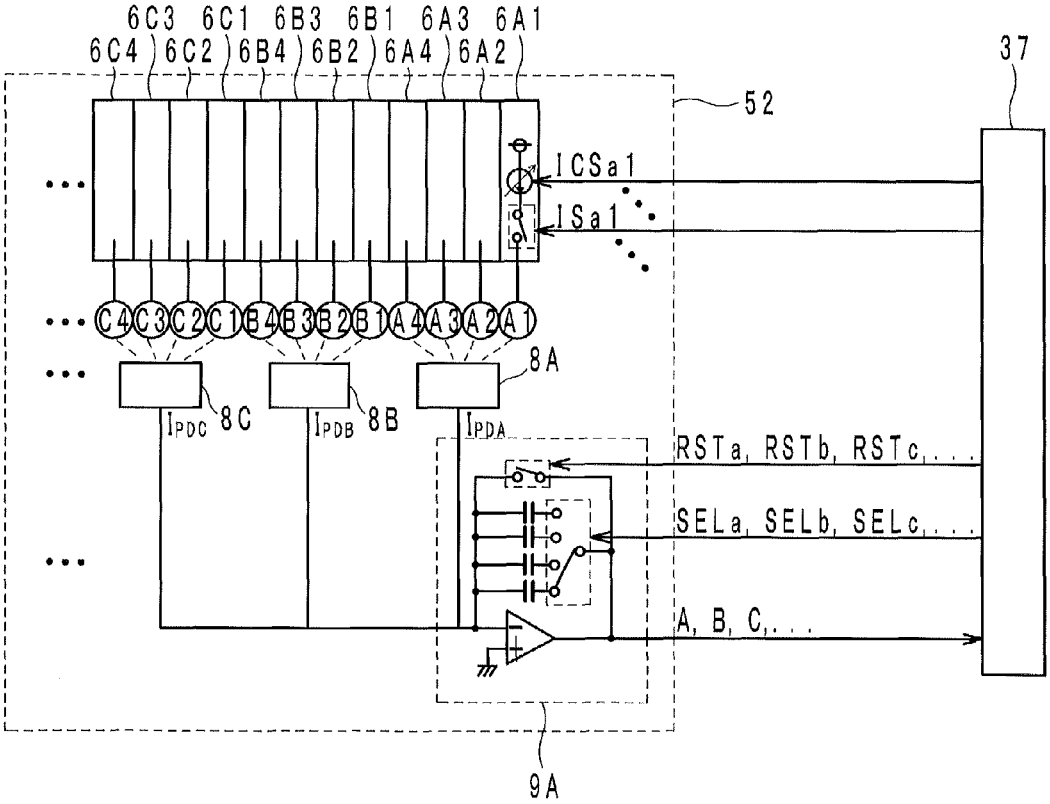
FIG. 12 is a gain switching circuit according to a third modification.

In the embodiments described above, the gain switch circuits 9A, 9B, 9C . . . are provided for the groups A, B, C . . . on a one-to-one basis. However, as shown in FIG. 12, one gain switch circuit 9A may be shared for a plurality of groups A, B, C . . . . In this case, the gain switch circuit 9A shall be time-shared such that the groups will be subjected to the gain setting and the light-quantity adjustment in non-overlapping time periods. This structure results in a reduction in the number of gain switch circuits, thereby reducing the cost for producing the OLED-PH 17.

The optical writing devices described above are capable of detecting the quantities of light emitted from the light-emitting points with a high degree of accuracy, and these optical writing devices are suited to be used as exposure devices, as optical drivers, etc. for MFPs.

Although the present invention has been described in connection with the preferred embodiments above, it is to be noted that various changes and modifications are possible for a person skilled in the art. Such changes and modifications are to be understood as being within the scope of the invention.

What is claimed is:

1. An optical writing device comprising:

a plurality of light-emitting points;

a plurality of drive units for supplying drive currents to the plurality of light-emitting points respectively;

a photodetector for outputting signals indicating quantities of light entering thereto from the respective light-emitting points;

a gain switch unit for outputting photodetection signals obtained by amplifying the signals output from the photodetector in regard to the respective light-emitting points with gains preset for the respective light-emitting points; and a control unit for controlling the drive units such that the photodetection signals output from the gain switch unit in regard to the respective light-emitting points coincide with a value substantially equal to a predetermined reference value, wherein the gains for the respective light-emitting points are preset based on the distances between the photodetector and the respective light-emitting points;

wherein the gain switch unit comprises at least one capacitor; and wherein the control unit is configured to set the gains for the respective light-emitting points preliminarily in the gain switch unit by determining a charge time on the capacitor for each of the light-emitting points based on the photodetection signal in regard to each of the light-emitting points.

2. The optical writing device according to claim 1, further comprising:

a lens for transmitting light emitted from the light emitting points to focus the light on an object;

wherein the gains for the respective light-emitting points are preset based on the distances between the photodetector and the respective light-emitting points and the transmittances of light emitted from the respective light-emitting points through the lens.

3. An image forming apparatus comprising:

the optical writing device according to claim 2, wherein the optical writing device is configured to carry out exposure of a photoreceptor drum.

4. An image forming apparatus comprising:

the optical writing device according to claim 1, wherein the optical writing device is configured to carry out exposure of a photoreceptor drum.

5. An optical writing device comprising:

a plurality of light-emitting points;

a lens for transmitting light emitted from the light emitting points to focus the light on an object;

a plurality of drive units for supplying drive currents to the plurality of light-emitting points respectively;

a photodetector for outputting signals indicating quantities of light entering thereto from the respective light-emitting points;

a gain switch unit for outputting photodetection signals obtained by amplifying the signals output from the photodetector in regard to the respective light-emitting points with gains preset for the respective light-emitting points; and a control unit for controlling the drive units such that the photodetection signals output from the gain switch unit in regard to the respective light-emitting points coincide with a value substantially equal to a predetermined reference value, wherein the gains for the respective light-emitting points are preset based on the transmittances of light emitted from the respective light-emitting points through the lens;

wherein the gain switch unit comprises at least one capacitor; and wherein the control unit is configured to set the gains for the respective light-emitting points preliminarily in the gain switch unit by determining a charge time on the capacitor for each of the light-emitting points based on the photodetection signal in regard to each of the light-emitting points.

6. An image forming apparatus comprising:

the optical writing device according to claim 5, wherein the optical writing device is configured to carry out exposure of a photoreceptor drum.

7. An optical writing device comprising:

a plurality of light-emitting points;

a plurality of drive units for supplying drive currents to the plurality of light-emitting points respectively;

a photodetector for outputting signals indicating quantities of light entering thereto from the respective light-emitting points;

a gain switch unit for outputting photodetection signals obtained by amplifying the signals output from the photodetector in regard to the respective light-emitting points with gains preset for the respective light-emitting points; and a control unit for controlling the drive units such that the photodetection signals output from the gain switch unit in regard to the respective light-emitting points coincide with a value substantially equal to a predetermined reference value, wherein the gains for the respective light-emitting points are preset based on the distances between the photodetector and the respective light-emitting points;

wherein the gain switch unit comprises a plurality of capacitors having different capacitance values; and wherein the control unit is configured to set the gains for the respective light-emitting points preliminarily in the gain switch unit by selecting one from the plurality of capacitors for each of the light-emitting points.

8. The optical writing device comprising:

a plurality of light-emitting points;

a plurality of drive units for supplying drive currents to the plurality of light-emitting points respectively;

a photodetector for outputting signals indicating quantities of light entering thereto from the respective light-emitting points;

a gain switch unit for outputting photodetection signals obtained by amplifying the signals output from the photodetector in regard to the respective light-emitting points with gains preset for the respective light-emitting points; and a control unit for controlling the drive units such that the photodetection signals output from the gain switch unit in regard to the respective light-emitting points coincide with a value substantially equal to a predetermined reference value, wherein the gains for the respective light-emitting points are preset based on the distances between the photodetector and the respective light-emitting points;

wherein the gain switch unit comprises a plurality of resistors having different resistance values; and wherein the control unit is configured to set the gains for the respective light-emitting points preliminarily in the gain switch unit by selecting one from the plurality of resistors for each of the light-emitting points based on the photodetection signal in regard to each of the light-emitting points.

9. An optical writing device comprising:

a plurality of light-emitting points;

a plurality of drive units for supplying drive currents to the plurality of light-emitting points respectively;

a photodetector for outputting signals indicating quantities of light entering thereto from the respective light-emitting points;

a gain switch unit for outputting photodetection signals obtained by amplifying the signals output from the photodetector in regard to the respective light-emitting points with gains preset for the respective light-emitting points; and a control unit for controlling the drive units such that the photodetection signals output from the gain switch unit in regard to the respective light-emitting points coincide with a value substantially equal to a predetermined reference value, wherein the control unit is configured to receive photodetection signals from the gain switch unit while making the respective light-emitting points emit light under a predetermined initial condition and sets the gains for the respective light-emitting points preliminarily in the gain switch unit based on the received photodetection signals;

wherein the gain switch unit comprises at least one capacitor; and wherein the control unit is configured to set the gains for the respective light-emitting points preliminarily in the gain switch unit by determining a charge time on the capacitor for each of the light-emitting points based on the photodetection signal in regard to each of the light-emitting points.

10. The optical writing device according to claim 9, wherein the gain switch unit comprises a plurality of capacitors having different capacitance values; and wherein the control unit is configured to set the gains for the respective light-emitting points preliminarily in the gain switch unit by selecting one from the plurality of capacitors for each of the light-emitting points based on the photodetection signal in regard to each of the light-emitting points.

11. An image forming apparatus comprising:

the optical writing device according to claim 9, wherein the optical writing device is configured to carry out exposure of a photoreceptor drum.

12. An optical writing device comprising:

a plurality of light-emitting points;

a plurality of drive units for supplying drive currents to the plurality of light-emitting points respectively;

a photodetector for outputting signals indicating quantities of light entering thereto from the respective light-emitting points;

a gain switch unit for outputting photodetection signals obtained by amplifying the signals output from the photodetector in regard to the respective light-emitting points with gains preset for the respective light-emitting points; and a control unit for controlling the drive units such that the photodetection signals output from the gain switch unit in regard to the respective light-emitting points coincide with a value substantially equal to a predetermined reference value, wherein the gains for the respective light-emitting points are preset based on the distances between the photodetector and the respective light-emitting points;

wherein the plurality of light-emitting points are divided into a plurality of groups; and wherein a plurality of photodetectors are provided in the optical writing device, each of the photodetectors outputting signals indicating quantities of light entering thereto from the light-emitting points in one of the groups.

* * * * *